US008157591B2

(12) United States Patent
Fedder et al.

(10) Patent No.: US 8,157,591 B2
(45) Date of Patent: Apr. 17, 2012

(54) ELECTRICAL CONNECTOR SYSTEM

(75) Inventors: James Lee Fedder, Etters, PA (US); John Edward Knaub, Etters, PA (US); E. Scott Martin, Manchester, PA (US); Lynn Robert Sipe, Mifflintown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 14 days.

(21) Appl. No.: 12/713,741

(22) Filed: Feb. 26, 2010

(65) Prior Publication Data

US 2010/0151741 A1 Jun. 17, 2010

Related U.S. Application Data

(63) Continuation-in-part of application No. 12/474,568, filed on May 29, 2009, now Pat. No. 7,976,318.

(60) Provisional application No. 61/200,955, filed on Dec. 5, 2008, provisional application No. 61/205,194, filed on Jan. 16, 2009.

(51) Int. Cl.
*H01R 13/648* (2006.01)

(52) U.S. Cl. ..... 439/607.07; 439/108

(58) Field of Classification Search ..... 439/108, 439/507–514, 607.06, 607.07, 931
See application file for complete search history.

(56) References Cited

U.S. PATENT DOCUMENTS

| | | | | |
|---|---|---|---|---|
| 5,354,219 | A * | 10/1994 | Wanjura | 439/607.12 |
| 5,882,227 | A | 3/1999 | Neidich | |
| 6,293,827 | B1 * | 9/2001 | Stokoe | 439/607.07 |
| 6,491,545 | B1 * | 12/2002 | Spiegel et al. | 439/579 |
| 6,506,076 | B2 | 1/2003 | Cohen et al. | |
| 6,676,450 | B2 | 1/2004 | Schroll | |
| 6,709,294 | B1 | 3/2004 | Cohen et al. | |
| 6,808,414 | B2 * | 10/2004 | Spiegel et al. | 439/579 |
| 6,899,566 | B2 | 5/2005 | Kline et al. | |
| 6,932,626 | B2 | 8/2005 | Costello et al. | |
| 7,163,421 | B1 | 1/2007 | Cohen et al. | |
| 7,207,807 | B2 | 4/2007 | Fogg | |
| 7,217,889 | B1 | 5/2007 | Parameswaran et al. | |
| 7,335,063 | B2 | 2/2008 | Cohen et al. | |
| 7,371,117 | B2 | 5/2008 | Gailus | |
| 7,381,092 | B2 * | 6/2008 | Nakada | 439/607.1 |
| 7,384,311 | B2 * | 6/2008 | Sharf et al. | 439/607.05 |
| 7,780,474 | B2 * | 8/2010 | Ito | 439/607.05 |
| 2003/0022555 | A1 | 1/2003 | Vicich et al. | |

* cited by examiner

*Primary Examiner* — Thanh Tam Le

(57) ABSTRACT

An electrical connector system may include a center housing that defines a plurality of first electrical contact channels on a first side face of the center housing and a plurality of second electrical contact channels on a second side face of the center housing. A first array of electrical contacts is positioned substantially within the plurality of first electrical contact channels on the first side face of the center housing. A second array of electrical contacts is positioned substantially within the plurality of second electrical contact channels on the second side face of the center housing. The first array of electrical contacts is paired with a third array of electrical contacts to form a first plurality of differential pairs of electrical contacts. The second array of electrical contacts is paired with a fourth array of electrical contacts to form a second plurality of differential pairs of electrical contacts.

24 Claims, 13 Drawing Sheets

ELECTRICAL CONNECTOR SYSTEM

PRIORITY CLAIM

This application is a continuation-in-part of U.S. patent application Ser. No. 12/474,568, filed May 29, 2009 now U.S. Pat. No. 7,976,318, which claims priority to U.S. Provisional Pat. App. No. 61/200,955, filed Dec. 5, 2008, and claims priority to U.S. Provisional Pat. App. No. 61/205,194, filed Jan. 16, 2009, the entirety of each of these applications is hereby incorporated by reference.

RELATED APPLICATIONS

The present application is related to U.S. patent application Ser. No. 12/474,568, U.S. patent application Ser. No. 12/474,587, U.S. patent application Ser. No. 12/474,605, U.S. patent application Ser. No. 12/474,545, U.S. patent application Ser. No. 12/474,505, U.S. patent application Ser. No. 12/474,772, U.S. patent application Ser. No. 12/474,626, and U.S. patent application Ser. No. 12/474,674, each titled "Electrical Connector System," each filed May 29, 2009, and each claiming priority to U.S. Provisional Pat. App. No. 61/200,955, filed Dec. 5, 2008 and U.S. Provisional Pat. App. No. 61/205,194, filed Jan. 16, 2009, the entirety of each of which is hereby incorporated by reference.

The present application is also related to U.S. patent application Ser. No. 12/641,904, titled "Electrical Connector System," filed Dec. 18, 2009, which is a continuation-in-part of U.S. patent application Ser. No. 12/474,605, the entirety of each of which is hereby incorporated by reference.

The present application is also related to U.S. patent application Ser. No. 12/648,700, titled "Electrical Connector System," filed Dec. 29, 2009, which is a continuation-in-part of U.S. patent application Ser. No. 12/474,674, the entirety of each of which is hereby incorporated by reference.

The present application is also related to U.S. patent application Ser. No. 12/713,710, titled "Electrical Connector System," filed Feb. 26, 2010, which is a continuation-in-part of U.S. patent application Ser. No. 12/474,568, the entirety of each of which is hereby incorporated by reference.

BACKGROUND

Backplane connector systems are typically used to connect a first substrate, such as a printed circuit board, in a parallel or perpendicular relationship with a second substrate, such as another printed circuit board. As the size of electronic components is reduced and electronic components generally become more complex, it is often desirable to fit more components in less space on a circuit board or other substrate. Consequently, it has become desirable to reduce the spacing between electrical terminals within backplane connector systems and to increase the number of electrical terminals housed within backplane connector systems. Accordingly, it is desirable to develop backplane connector systems capable of operating at increased speeds, while also increasing the number of electrical terminals housed within the backplane connector system.

SUMMARY

An electrical connector system may include a center housing that defines a plurality of first electrical contact channels on a first side face of the center housing and a plurality of second electrical contact channels on a second side face of the center housing. A first array of electrical contacts is positioned substantially within the plurality of first electrical contact channels on the first side face of the center housing. A second array of electrical contacts is positioned substantially within the plurality of second electrical contact channels on the second side face of the center housing. The first array of electrical contacts is paired with a third array of electrical contacts to form a first plurality of differential pairs of electrical contacts. The second array of electrical contacts is paired with a fourth array of electrical contacts to form a second plurality of differential pairs of electrical contacts.

In another implementation, an electrical connector system includes a first center housing that defines a plurality of first electrical contact channels on a first side face of the first center housing and a plurality of second electrical contact channels on a second side face of the first center housing. A first array of electrical contacts is positioned substantially within the plurality of first electrical contact channels on the first side face of the first center housing. A second center housing defines a plurality of first electrical contact channels on a first side face of the second center housing and a plurality of second electrical contact channels on a second side face of the second center housing. A second array of electrical contacts is positioned substantially within the plurality of second electrical contact channels on the second side face of the second center housing. The first and second center housings are positioned adjacent to one another in the electrical connector system such that the first array of electrical contacts is positioned adjacent to the second array of electrical contacts to form a plurality of differential pairs of electrical contacts.

In yet another implementation, an electrical connector system includes a center housing that defines a plurality of first electrical contact channels on a first side face of the center housing and a plurality of second electrical contact channels on a second side face of the center housing. A first array of electrical contacts is positioned substantially within the plurality of first electrical contact channels on the first side face of the center housing. A second array of electrical contacts is positioned substantially within the plurality of second electrical contact channels on the second side face of the center housing. A first end housing of the electrical connector system defines a plurality of electrical contact channels on a side face of the first end housing. A third array of electrical contacts is positioned substantially within the plurality of electrical contact channels on the side face of the first end housing. A second end housing defines a plurality of electrical contact channels on a side face of the second end housing. A fourth array of electrical contacts is positioned substantially within the plurality of electrical contact channels on the side face of the second end housing. The first array of electrical contacts is part of a different differential signaling pair of arrays than the second array of electrical contacts.

In a further implementation, an electrical connector system includes a center housing that defines a plurality of first electrical contact channels on a first side face of the center housing and a plurality of second electrical contact channels on a second side face of the center housing. A first array of electrical contacts is positioned substantially within the plurality of first electrical contact channels on the first side face of the center housing. A second array of electrical contacts is positioned substantially within the plurality of first electrical contact channels on the first side face of the center housing. A third array of electrical contacts is positioned substantially within the plurality of second electrical contact channels on the second side face of the center housing. A fourth array of electrical contacts is positioned substantially within the plurality of second electrical contact channels on the second side face of the center housing. The first array of electrical contacts is paired with the second array of electrical contacts to form a first plurality of differential pairs of electrical contacts. The third array of electrical contacts is paired with the fourth array of electrical contacts to form a second plurality of differential pairs of electrical contacts.

Other systems, methods, features and advantages will be, or will become, apparent to one with skill in the art upon examination of the following figures and detailed description.

DETAILED DESCRIPTION

Figure 1:
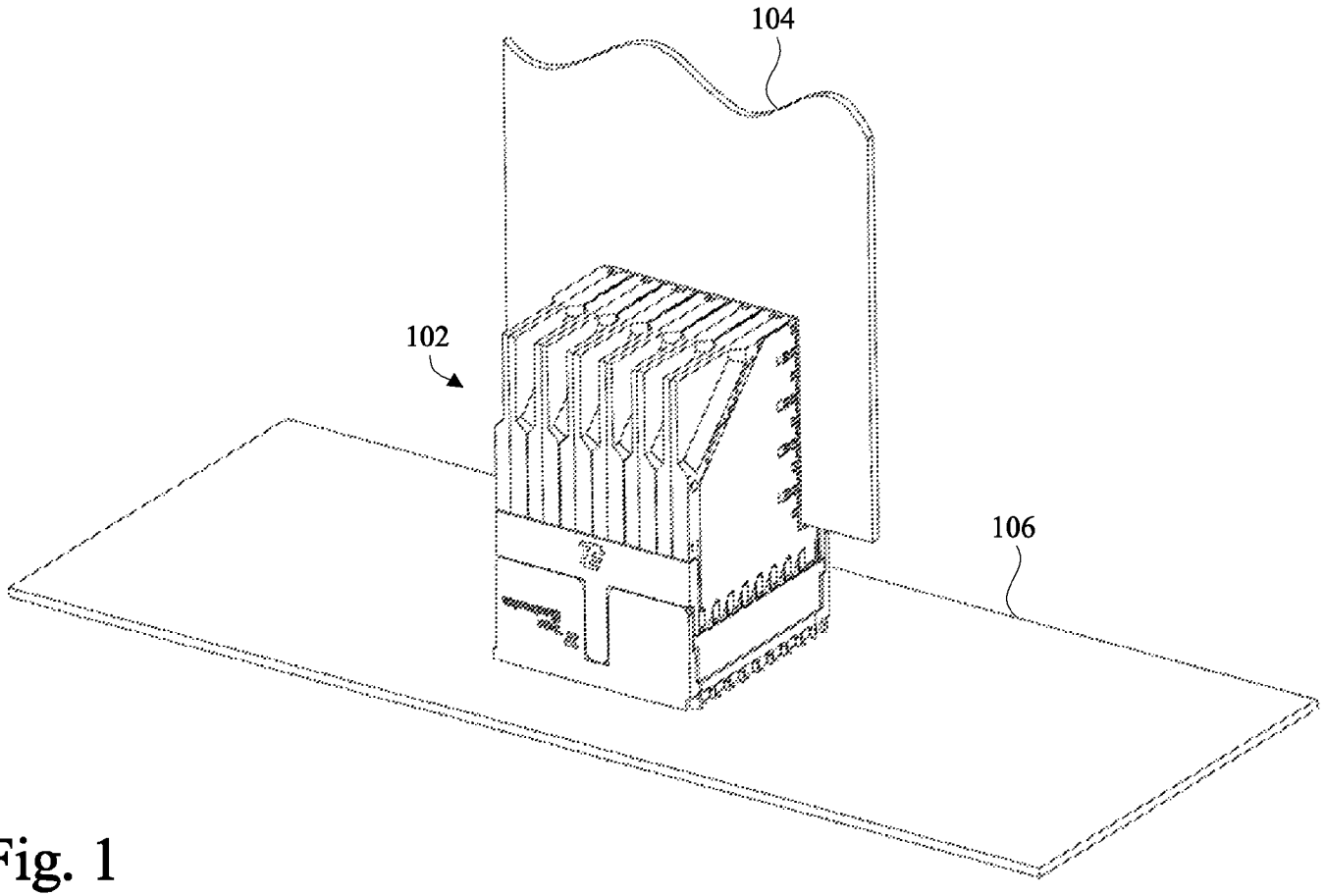
FIG. 1 is a diagram of a backplane connector system connecting a first substrate to a second substrate.

The present disclosure is directed to backplane connector systems that connect with one or more substrates. The backplane connector systems may be capable of operating at high speeds (e.g., up to at least about 25 Gbps), while in some implementations also providing high pin densities (e.g., at least about 50 pairs of electrical connectors per inch). In one implementation, as shown in FIG. 1, a backplane connector system 102 may be used to connect a first substrate 104, such as a printed circuit board, in a parallel or perpendicular relationship with a second substrate 106, such as another printed circuit board Implementations of the disclosed connector systems may include ground shielding structures that substantially encapsulate electrical connector pairs, which may be differential electrical connector pairs, in a three-dimensional manner throughout a backplane footprint, a backplane connector, and/or a daughtercard footprint. These encapsulating ground structures, along with a dielectric filler of the differential cavities surrounding the electrical connector pairs themselves, may prevent undesirable propagation of non-traverse, longitudinal, and higher-order modes during operation of the high-speed backplane connector systems.

Figure 2:
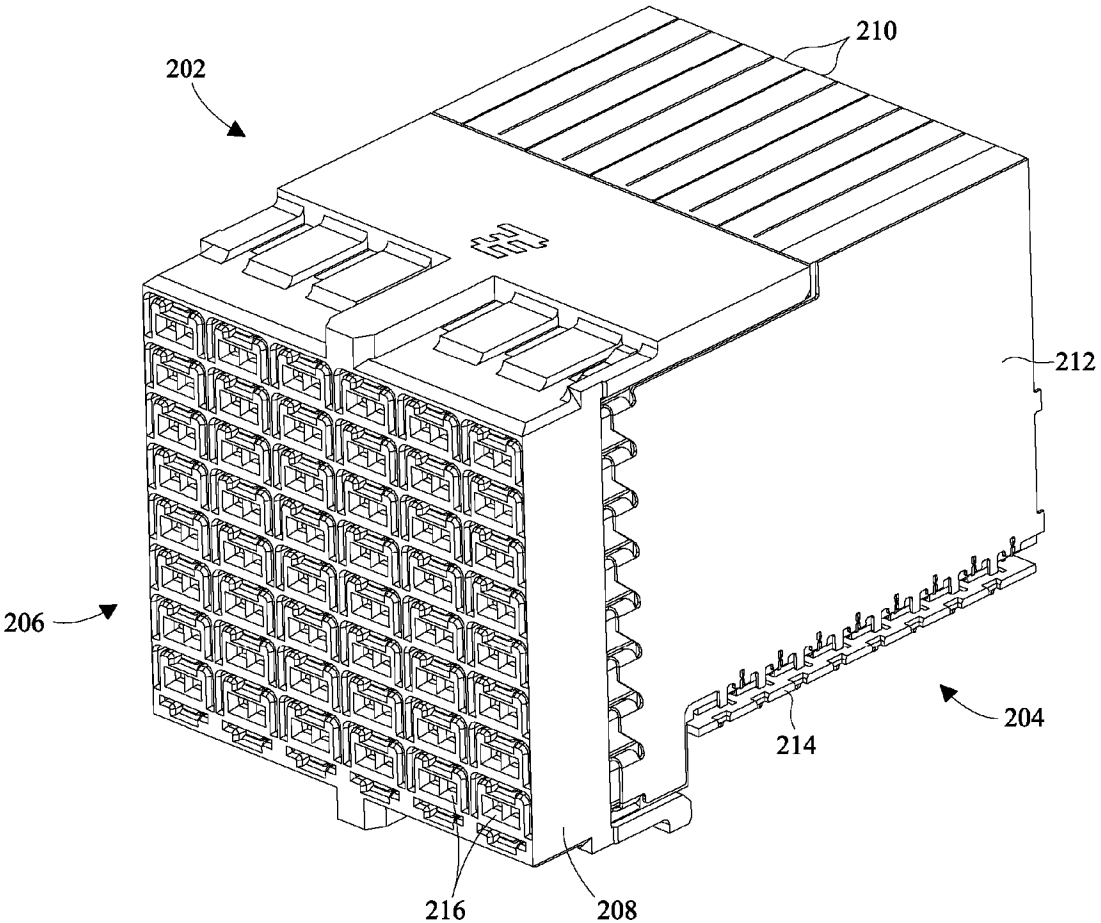
FIG. 2 is a perspective view of an electrical connector system that includes multiple wafer assemblies.

FIG. 2 is a perspective view of an electrical connector system 202 for connecting multiple substrates. In one implementation, the electrical connector system 202 has a mounting end 204 that connects with a first substrate and a mating end 206 that connects with a second substrate. The connections with the first substrate or the second substrate may be direct or through an interfacing connector. The first and second substrates may be arranged in a substantially perpendicular relationship when engaged with the electrical connector system 202. The electrical connector system 202 may include one or more wafer housings 208, one or more wafer assemblies 210, one or more ground shields 212, and one or more organizers 214. Additionally, the electrical connector system 202 may include one or more ground potential connection components that provide a common ground potential between multiple wafer assemblies 210 and the substrate. For example, the electrical connector system 202 may include one or more ground strips coupled between the wafer assemblies 210 and the substrate at the mounting end 204 of the electrical connector system 202, as described in U.S. patent application Ser. No. 12/641,904.

The wafer housing 208 serves to receive and position multiple wafer assemblies 210 adjacent to one another within the electrical connector system 202. In one implementation, the wafer housing 208 engages the wafer assemblies 210 at the mating end 206. One or more apertures 216 in the wafer housing 208 are dimensioned to allow mating connectors extending from the wafer assemblies 210 to pass through the wafer housing 208 so that the mating connectors may be connected with corresponding mating connectors associated with a substrate or another mating device, such as the header modules described in U.S. patent application Ser. No. 12/474,568.

The ground shield 212 may be coupled to a side face of one or more of the wafer assemblies 210 or may be integrated into a housing of one of the wafer assemblies 210. The ground shield 212 may include substrate engagement elements, such as ground mounting pins, at the mounting end 204 of the electrical connector system 202 to engage with a substrate when the electrical connector system 202 is mounted to the substrate.

The organizer 214 is shown positioned at the mounting end 204 of the electrical connector system 202. The organizer 214 includes apertures dimensioned to allow substrate engagement elements, such as the electrical contact mounting pins, to pass through the organizer 214 and connect with a substrate.

Figure 3:
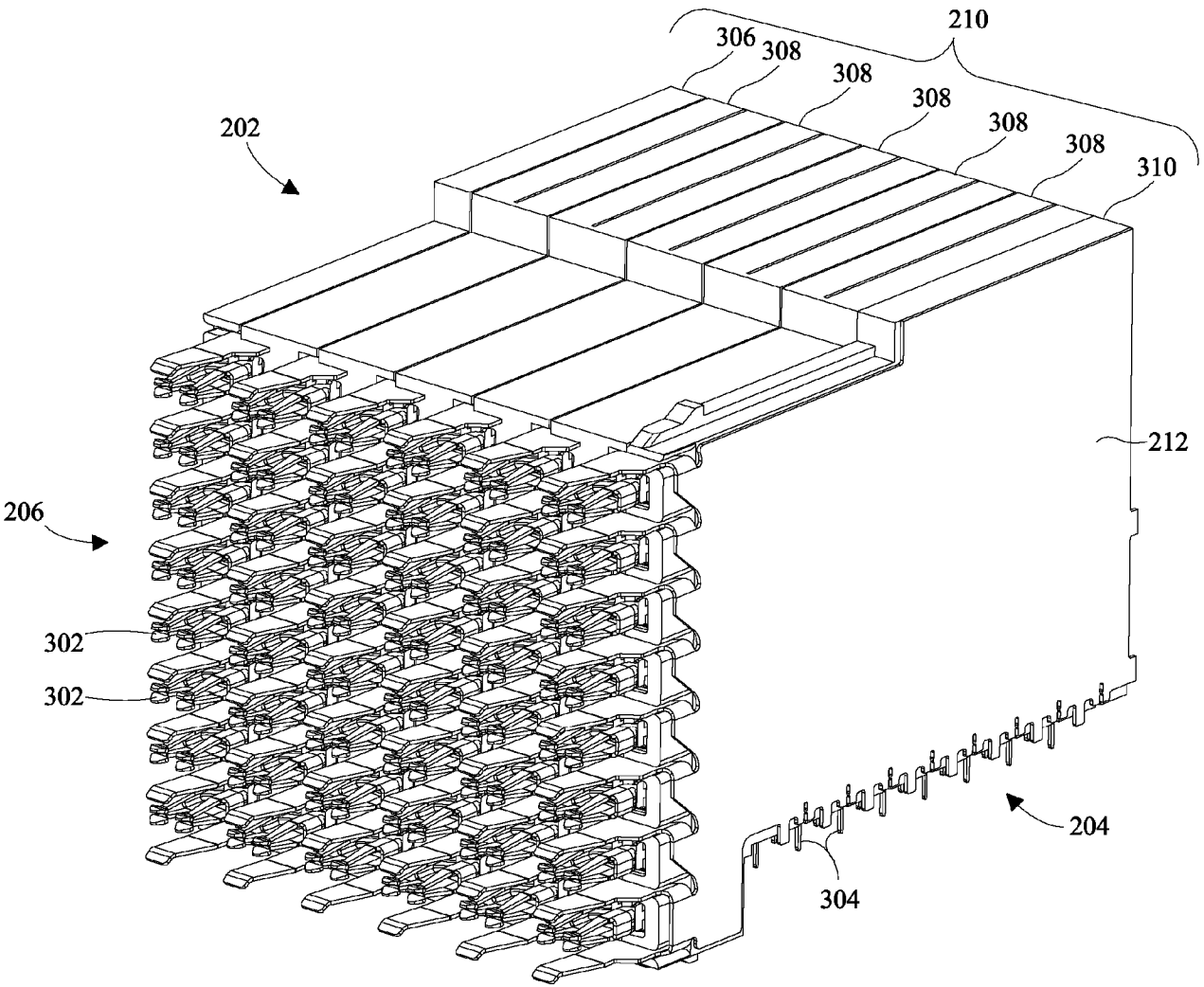
FIG. 3 is another view of the electrical connector system of FIG. 2.

FIG. 3 is another view of the electrical connector system 202 where the wafer housing 208 and the organizer 214 have been removed to expose mating connectors 302 and mounting connectors 304 of the wafer assemblies 210. Each of the wafer assemblies 210 provides one or more arrays of electrical paths between multiple substrates. The electrical paths may be signal transmission paths, power transmission paths, or ground potential paths. One of the mating connectors 302 may be located at one end of each electrical path of an array, and one of the mounting connectors 304 may be located at the other end of each electrical path of an array.

The mating connectors 302 extend out from the mating end 206 of the electrical connector system 202 to couple with a first substrate or another mating device, such as a header module. The mating connectors 302 may be closed-band shaped, tri-beam shaped, dual-beam shaped, circular shaped, male, female, hermaphroditic, or another mating connector style. Similarly, the mounting connectors 304 extend out from the mounting end 204 of the electrical connector system 202 to couple with a second substrate or another mating device. The mounting connectors 304 may be electrical contact pins that are dimensioned to fit into corresponding holes or vias in the substrate to make connection with the substrate.

As shown in FIG. 3, the electrical connector system 202 and the wafer assemblies 210 may be formed from several different housing components. For example, the electrical connector system may include one or more first end housings 306, one or more center housings 308, and one or more second end housings 310. The electrical connector system 202 shown in FIG. 3 is formed from one first end housing 306, five center housings 308, and one second end housing 310. In other implementations, different housing arrangements may be used, such as including multiple first end housings 306, including multiple second end housings 308, using less center housings 308, using more center housings 308, or the like. The number and configuration of the housing components in the electrical connector system 202 may be customized to meet the needs of the application.

Figure 4:
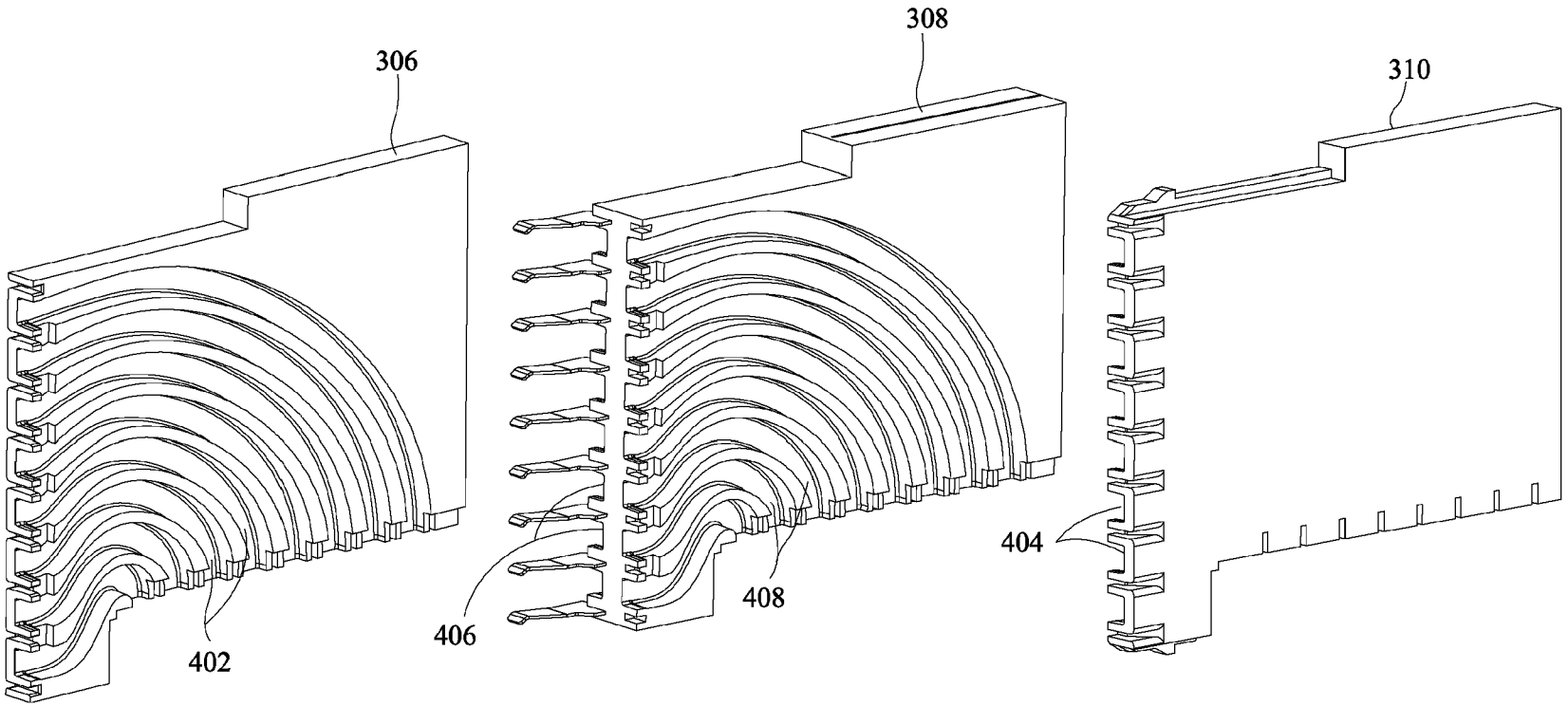
FIG. 4 shows one center housing and two end housings of the electrical connector system of FIG. 2.

FIG. 4 shows more detail of the first end housing 306, the center housing 308, and the second end housing 310 of the electrical connector system 202. In one implementation, each of the housing components includes a conductive surface that defines a plurality of channels dimensioned to receive one or more arrays of electrical contacts. For example, the first end housing 306 may include a plurality of channels 402 on a first side face of the first end housing 306, but not on the second side face. Similarly, the second end housing 310 may include a plurality of channels 404 on a first side face of the second end housing 310, but not on the second side face. Therefore, the end housings 306 and 310 may accommodate an array of electrical contacts on only one side. The center housing 308, on the other hand, may include a plurality of channels on each side face of the center housing 308. For example, the center housing 308 may include a first plurality of channels 406 on a first side face of the center housing 308, and a second plurality of channels 408 on a second side face of the center housing 308. Therefore, the center housing 308 may accommodate an array of electrical contacts on each side. The channels 406 on the first side face of the center housing 308 may be substantially similar to the channels 408 on the second side face of the center housing 308.

The first end housing 306, the center housing 308, and/or the second end housing 310 may be formed to have a conductive surface. For example, the housings may be formed as plated plastic ground shell housings. In some implementations, each of the housings comprises a plated plastic or diecast ground wafer, such as tin (Sn) over nickel (Ni) plated or a zinc (Zn) die cast. In other implementations, the housings may comprise an aluminum (Al) die cast, a conductive polymer, a metal injection molding, or any other type of metal.

Figure 5:
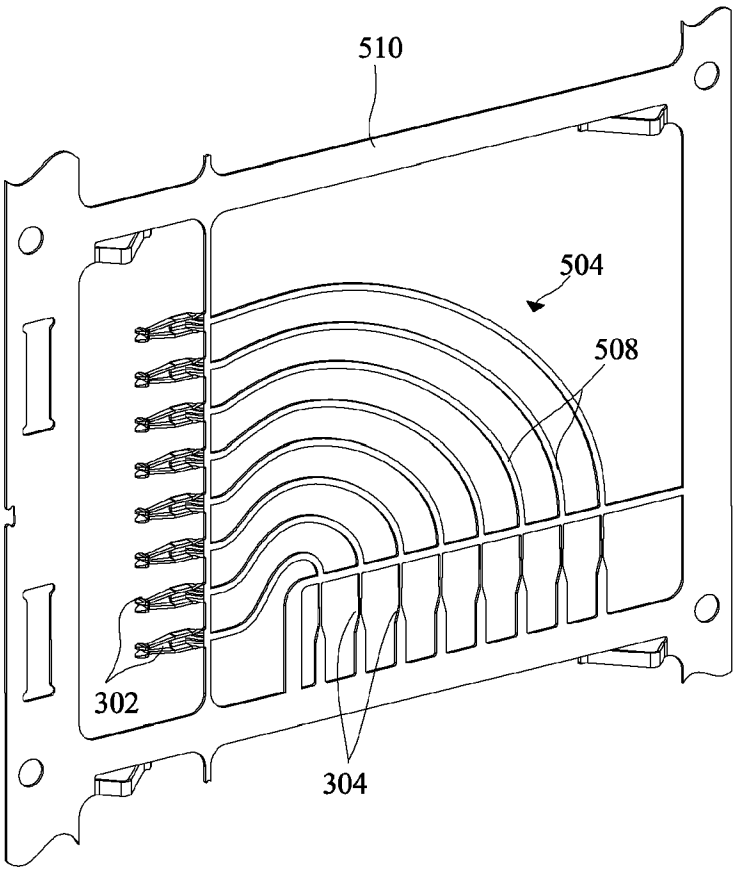
FIG. 5 shows arrays of electrical contacts of the electrical connector system of FIG. 2.
Figure 5:
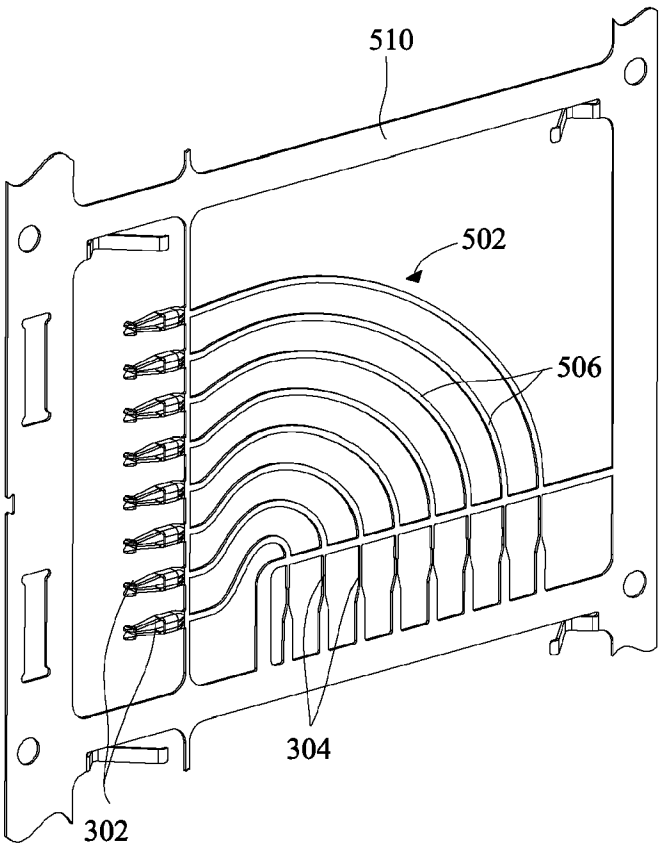

FIG. 5 shows a first array of electrical contacts 502 (also known as a first lead frame assembly) and a second array of electrical contacts 504 (also known as a second lead frame assembly). Each of the arrays of electrical contacts 502 and 504 may include multiple electrical paths between the substrates. For example, the first array of electrical contacts 502 may include a plurality of electrical paths 506, and the second array of electrical contacts 504 may include a plurality of electrical paths 508. The electrical paths 506 and 506 provide the signal transmission paths, power transmission paths, or ground potential paths for the wafer assemblies 210 shown in FIG. 3. As shown in FIG. 5, a mating connector 302 may be located at one end of each electrical path of an array, and a mounting connector 304 may be located at the other end of each electrical path of an array.

The arrays of electrical contacts 502 and 504 may be formed from a conductive material. In some implementations, the arrays of electrical contacts 502 and 504 comprise phosphor bronze and gold (Au) or tin (Sn) over nickel (Ni) plating. In other implementations, the arrays of electrical contacts 502 and 504 may comprise any copper (Cu) alloy material. The platings could be any noble metal such as palladium (Pd) or an alloy such as palladium-nickel (Pd—Ni) or gold (Au) flashed palladium (Pd) in the contact area, tin (Sn) or nickel (Ni) in the mounting area, and nickel (Ni) in the underplating or base plating. Each of the arrays of electrical contacts 502 and 504 are shown in FIG. 5 with a manufacturing frame 510 that may be removed before operation.

Figure 6:
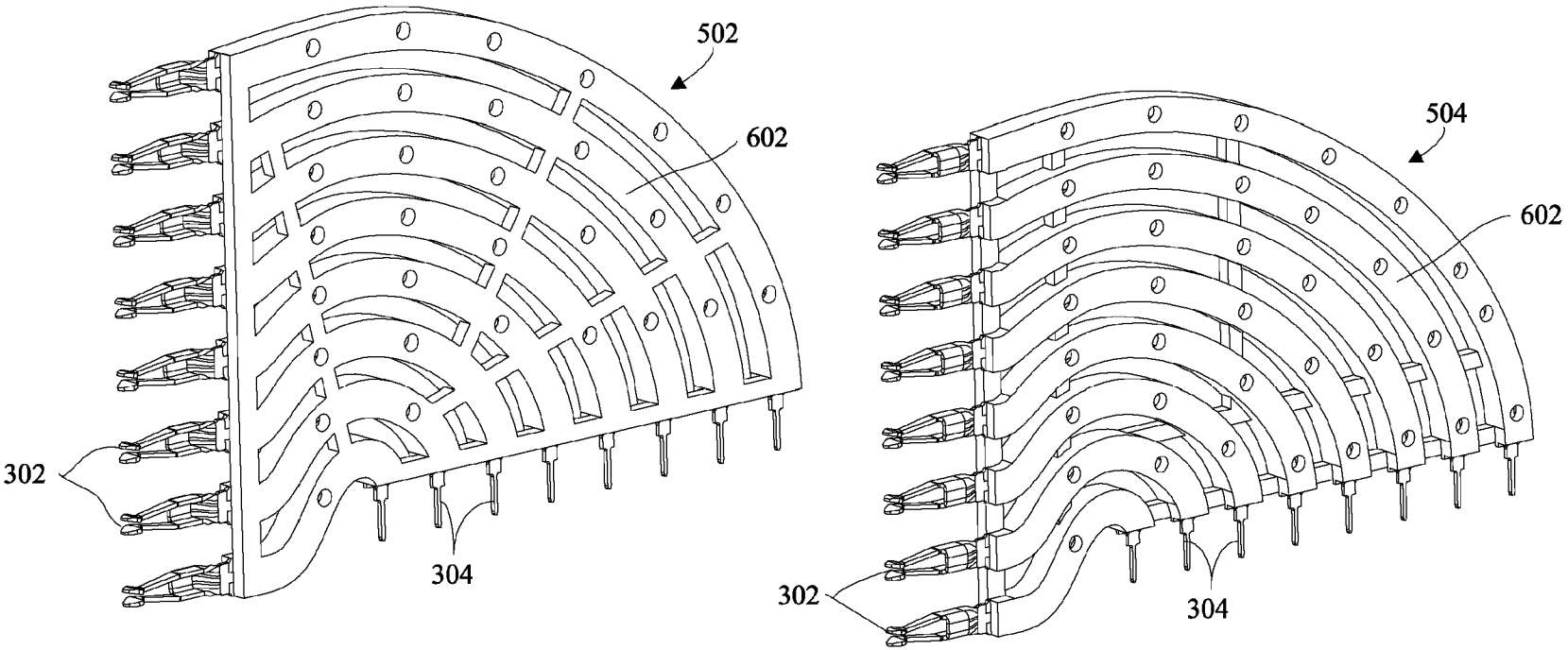
FIG. 6 shows overmolded arrays of electrical contacts of the electrical connector system of FIG. 2.

FIG. 6 shows the arrays of electrical contacts 502 and 504 after the addition of an overmolded insulation layer 602, such as an overmolded plastic dielectric. In FIG. 6, the arrays of electrical paths 506 and 508 shown in FIG. 5 are at least partially surrounded by the overmolded insulation layer 602. The overmolded insulation layer 602 may isolate the arrays of electrical paths 506 and 508 from other conductive surfaces. FIG. 6 also shows the arrays of electrical contacts 502 and 504 after removal of the manufacturing frame 510 shown in FIG. 5.

Figure 7:
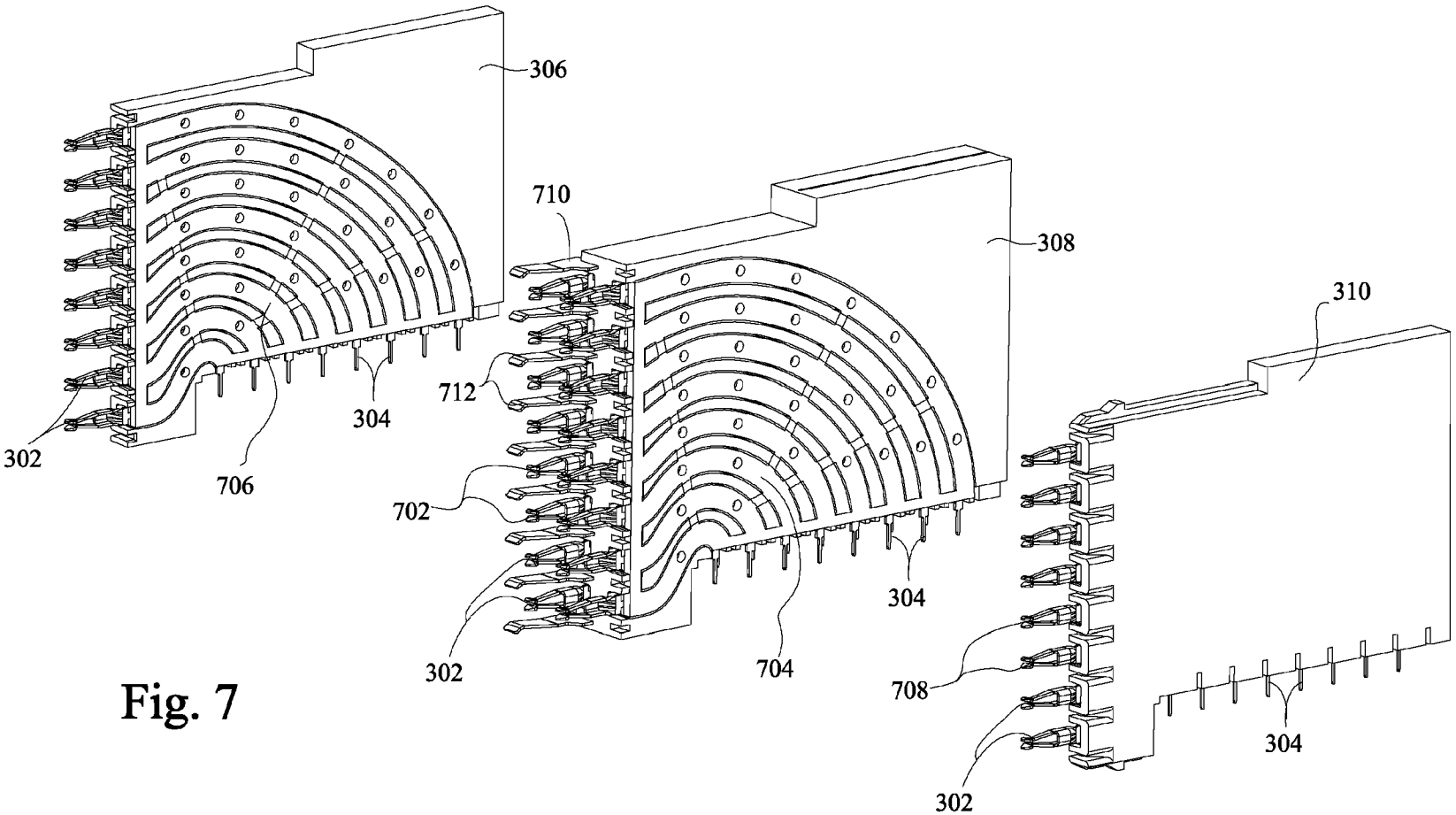
FIG. 7 shows arrays of electrical contacts placed into channels in the housing components of FIG. 4.

FIG. 7 shows multiple arrays of electrical contacts placed into channels in the housing components 306, 308, and 310. In FIG. 7, a first array of electrical contacts 702 is positioned substantially within the channels on a first side face of the center housing 308. A second array of electrical contacts 704 is positioned substantially within the channels on a second side face of the center housing 308. In one implementation, the first array of electrical contacts 702 is part of a different differential pair of arrays than the second array of electrical contacts 704. In this implementation, the first array of electrical contacts 702 may be paired with a third array of electrical contacts 706 to form a first plurality of differential pairs of electrical contacts. The third array of electrical contacts 706 may be positioned substantially within the channels of a first end housing 306, as shown in FIG. 7. The second array of electrical contacts 704 may be paired with a fourth array of electrical contacts 708 to form a second plurality of differential pairs of electrical contacts. The fourth array of electrical contacts 708 may be positioned substantially within the channels of a second end housing 310, as shown in FIG. 7.

When the first array of electrical contacts 702 is positioned substantially within the plurality of channels on the first side of the center housing 308, the third array of electrical contacts 706 is positioned substantially within the plurality of channels of the first end housing 306, and the first end housing 306 is coupled with the center housing 308, each electrical contact of the first array of electrical contacts 702 may be positioned adjacent to an electrical contact of the third array of electrical contacts 706. In some implementations, the first and third arrays of electrical contacts 702 and 706 are positioned in the plurality of channels such that a distance between adjacent electrical contacts is substantially the same throughout the wafer assembly 210. Together, the adjacent electrical contacts of the first and third arrays of electrical contacts 702 and 706 form a series of electrical contact pairs. In some implementations, the electrical contact pairs may be differential pairs of electrical contacts. For example, the electrical contact pairs may be used for differential signaling.

Similarly, when the second array of electrical contacts 704 is positioned substantially within the plurality of channels on the second side of the center housing 308, the fourth array of electrical contacts 708 is positioned substantially within the plurality of channels of the second end housing 310, and the second end housing 310 is coupled with the center housing 308, each electrical contact of the second array of electrical contacts 704 may be positioned adjacent to an electrical contact of the fourth array of electrical contacts 706. In some implementations, the adjacent electrical contacts of the second and fourth arrays of electrical contacts 704 and 708 form a series of electrical contact pairs, such as differential signaling pairs of electrical contacts.

In some implementations, for each electrical contact pair, the electrical contact of the one array of electrical contacts mirrors the adjacent electrical contact of the other array of electrical contacts. Mirroring the electrical contacts of the electrical contact pair may provide advantages in manufacturing as well as column-to-column consistency for high-speed electrical performance, while still providing a unique structure in pairs of two columns.

The electrical contact channels in the housing components 306, 308, and 310 may be lined with an insulation layer, such as an overmolded plastic dielectric, so that when the arrays of electrical contacts 702, 704, 706, and 708 are positioned substantially within their respective channels, the insulation layer electrically isolates the electrical contacts from the conductive surface of the housing components 306, 308, and 310. In other implementations, the insulation layer may be applied directly to the arrays of electrical contacts 702, 704, 706, and 708 to electrically isolate conductive portions of the arrays from the electrically conductive surfaces of the electrical contact channels. After the arrays of electrical contacts 702, 704, 706, and 708 have been positioned within the housing components 306, 308, and 310, the housings 306, 308, and 310 may be joined together to form multiple wafer assemblies 210 of an electrical connector system 202.

The arrays of electrical contacts 702, 704, 706, and 708 may each define a plurality of signal substrate engagement elements, such as the mounting connectors 304, dimensioned to extend past a mounting end of the housings and connect with a plurality of first signal vias of a substrate. Each of the arrays 702, 704, 706, and 708 may also define a plurality of mating connectors 302 dimensioned to extend past a mating end of the housings and engage with corresponding mating connectors of a substrate or intermediate connector.

In some implementations, the center housing 308 may include a ground shield 710 extending through, or embedded in, a portion of the center housing 308. The ground shield 710 may be attached to an outer surface of the center housing 308 or may be an integral portion of the center housing 308. The ground shield may include a plurality of ground tabs 712 dimensioned to extend past the mating end of the center housing 308 and block a line-of-sight between each mating connector 302 of an array of electrical contacts. In some implementations, one of the ground mating tabs 712 is positioned above a pair of mating connectors, and another ground mating tab 712 is positioned below the pair. For example, the ground tabs 712 may be spaced from each other so that a pair of mating connectors may fit in a space between the adjacent mating tabs 712.

Figure 8:
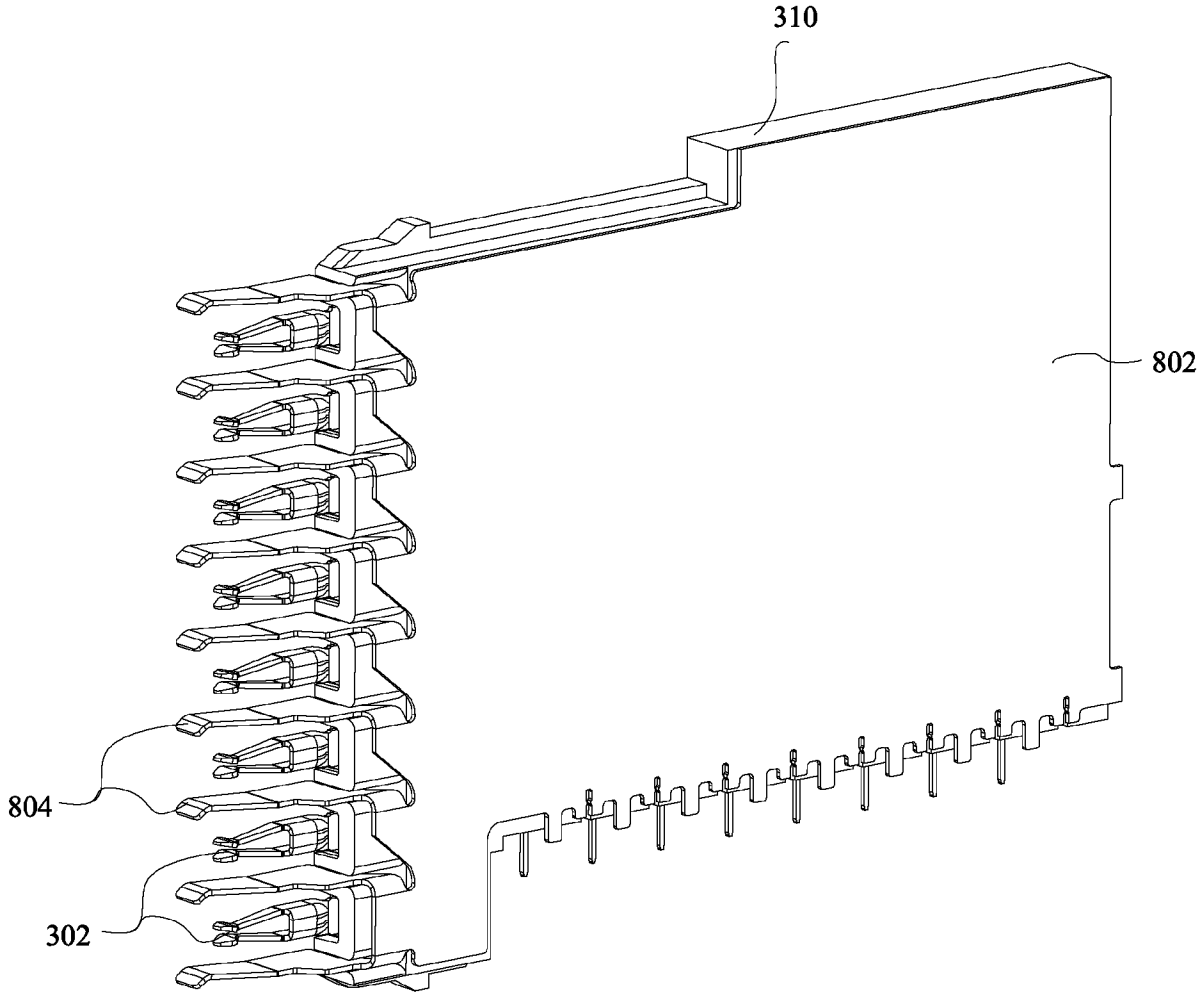
FIG. 8 shows a ground shield coupled with one of the end housings of FIG. 4.

As shown in FIG. 8, some implementations may also include a ground shield 802 coupled with one of the end housings. FIG. 8 shows the ground shield 802 coupled with the end housing 310. The ground shield 802 may be attached to an outer surface of the end housing 310 or may be an integral portion of the end housing 310. Like the ground shield 710 shown coupled with the center housing 308 in FIG. 7, the ground shield 802 may include a plurality of ground tabs 804 dimensioned to extend past the mating end of the end housing 310 and block a line-of-sight between each mating connector 302 of an array of electrical contacts.

FIG. 7 shows an implementation with one center housing and two end housings, which would result in two differential pairs of arrays formed from the four arrays of electrical contacts 702, 704, 706, and 708. Alternatively, multiple instances of the center housing 308 may be used to form an electrical connector with a larger number of arrays and thus a larger number of differential pairs of arrays. In this alternative implementation, an array of electrical contacts may be positioned substantially within the channels of another two-sided center housing that is similar to the center housing 308. This additional array may be half of a differential pair with one of the arrays 702, 704, 706, and 708. For example, if the additional center housing is positioned between the first end housing 306 and the center housing 308, then the array positioned in the additional center housing may be paired with either the array 702 or the array 706 depending on which side of the additional center housing the additional array is located. Similarly, if the additional center housing is positioned between the second end housing 310 and the center housing 308, then the array positioned in the additional center housing may be paired with either the array 704 or the array 708 depending on which side of the additional center housing the additional array is located.

Some implementations may include an instance of the center housing 308 on both sides of the center housing 308. In an implementation with three of the center housings 308 and two end housings 306 and 310, eight arrays of electrical contacts may be accommodated to form four pairs of arrays. A first array of electrical contacts in the first end housing may be paired with a second array of electrical contacts on the first side of the first center housing. A third array of electrical contacts on the second side of the first center housing may be paired with a fourth array of electrical contacts on the first side of the second center housing. A fifth array of electrical contacts on the second side of the second center housing may be paired with a sixth array of electrical contacts on the first side of the third center housing. Finally, a seventh array of electrical contacts on the second side of the third center housing may be paired with an eighth array of electrical contacts in the second end housing. Other alternatives may include even more center housings, such the electrical connector system shown in FIG. 3 which includes five center housings.

Figure 9:
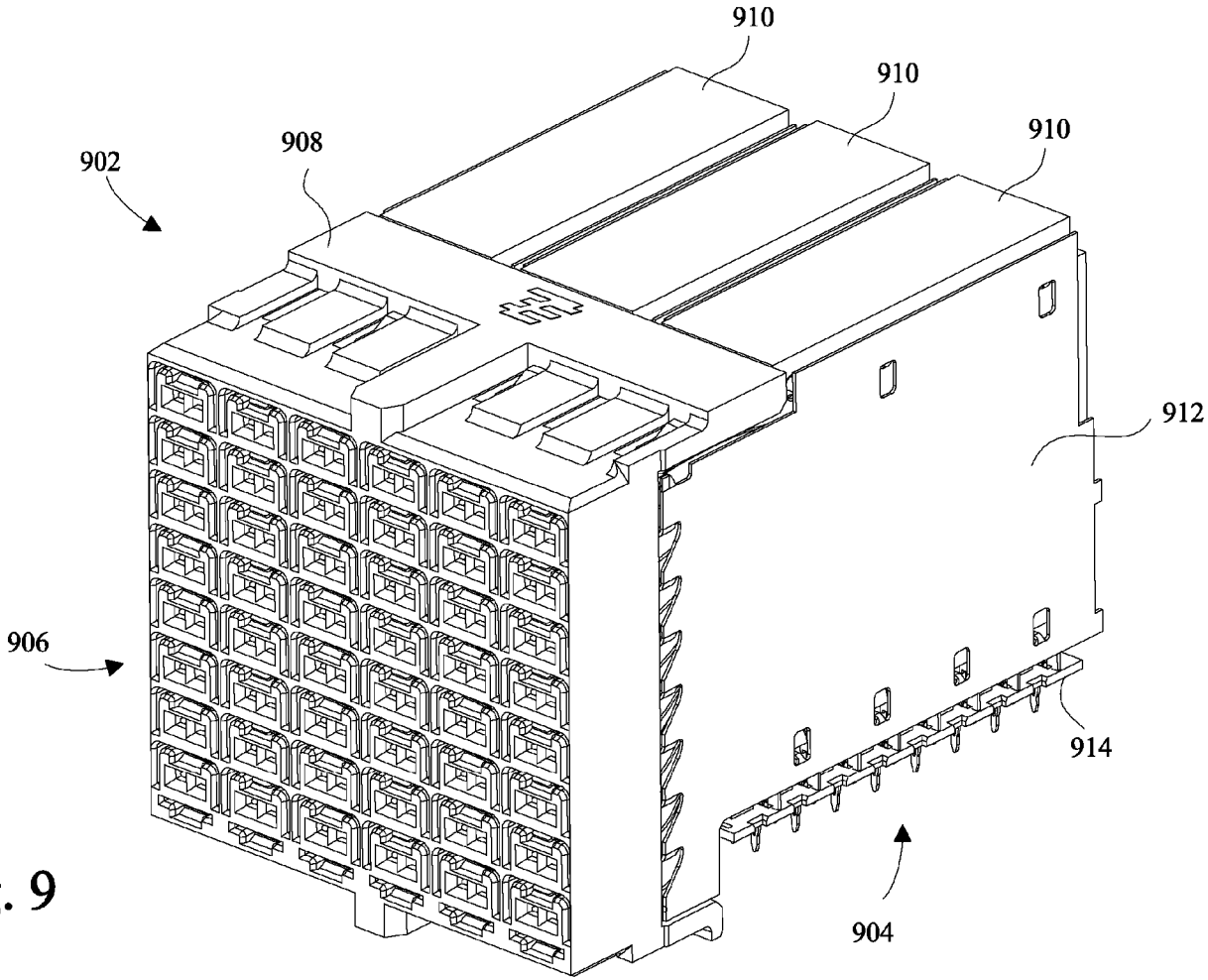
FIG. 9 is a perspective view of another electrical connector system that includes multiple wafer assemblies.

FIG. 9 is a perspective view of another electrical connector system 902 that may connect multiple substrates. In one implementation, the electrical connector system 902 has a mounting end 904 that connects with a first substrate and a mating end 906 that connects with a second substrate. The connections with the first substrate or the second substrate may be direct or through an interfacing connector. The first and second substrates may be arranged in a substantially perpendicular relationship when engaged with the electrical connector system 902.

The electrical connector system 902 may include one or more wafer housings 908, one or more wafer assemblies 910, one or more ground shields 912, and one or more organizers 914. Additionally, the electrical connector system 902 may include one or more ground potential connection components that provide a common ground potential between multiple wafer assemblies 910 and the substrate. For example, the electrical connector system 902 may include one or more ground strips coupled between the wafer assemblies 910 and the substrate at the mounting end 904 of the electrical connector system 902, as described in U.S. patent application Ser. No. 12/641,904.

In one implementation, the wafer housing 908, the ground shield 912, and the organizer 914 may be substantially similar to the wafer housing 208, the ground shields 212, and the organizers 214 of the electrical connector system 202, as described above. One difference between the various components of the electrical connector system 202 and the electrical connector system 902 may be that the components of the electrical connector system 902 may have different dimensions or configurations than the components of the electrical connector system 202. The size or configuration differences serve to accommodate the size and/or configuration differences between the wafer assemblies 210 of the electrical connector system 202 and the wafer assemblies 910 of the electrical connector system 902. For example, the wafer assemblies 910 shown in FIG. 9 may include a wider housing component dimensioned to accommodate additional arrays of electrical contacts.

Figure 10:
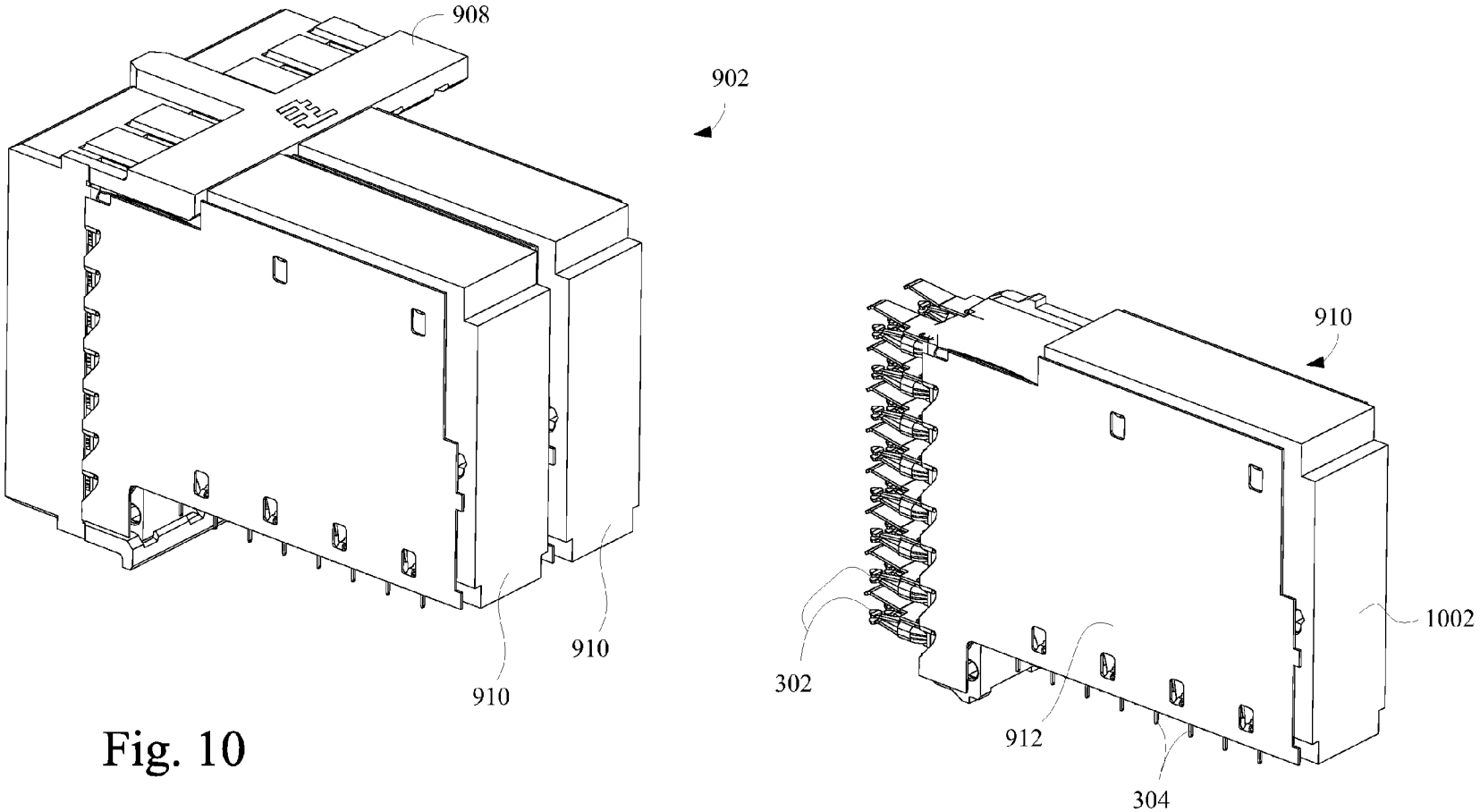
FIG. 10 is a partially exploded view of the electrical connector system of FIG. 9.

FIG. 10 is a partially exploded view of the electrical connector system 902 that shows one of the wafer assemblies 910 disengaged from the wafer housing 908. The electrical connector system 902 shown in FIG. 10 includes three wafer assemblies 910. In other implementations, the electrical connector system 902 may include a different number of wafer assemblies 910. The number of wafer assemblies 910 in the electrical connector system 902 may be customized to meet the needs of the application. Each of the wafer assemblies 910 may include a housing component 1002, multiple arrays of electrical contacts (only the mating connectors 302 and the mounting connectors 304 of the arrays of electrical contacts are visible in FIG. 10), and one or more ground shields 912.

Figure 11:
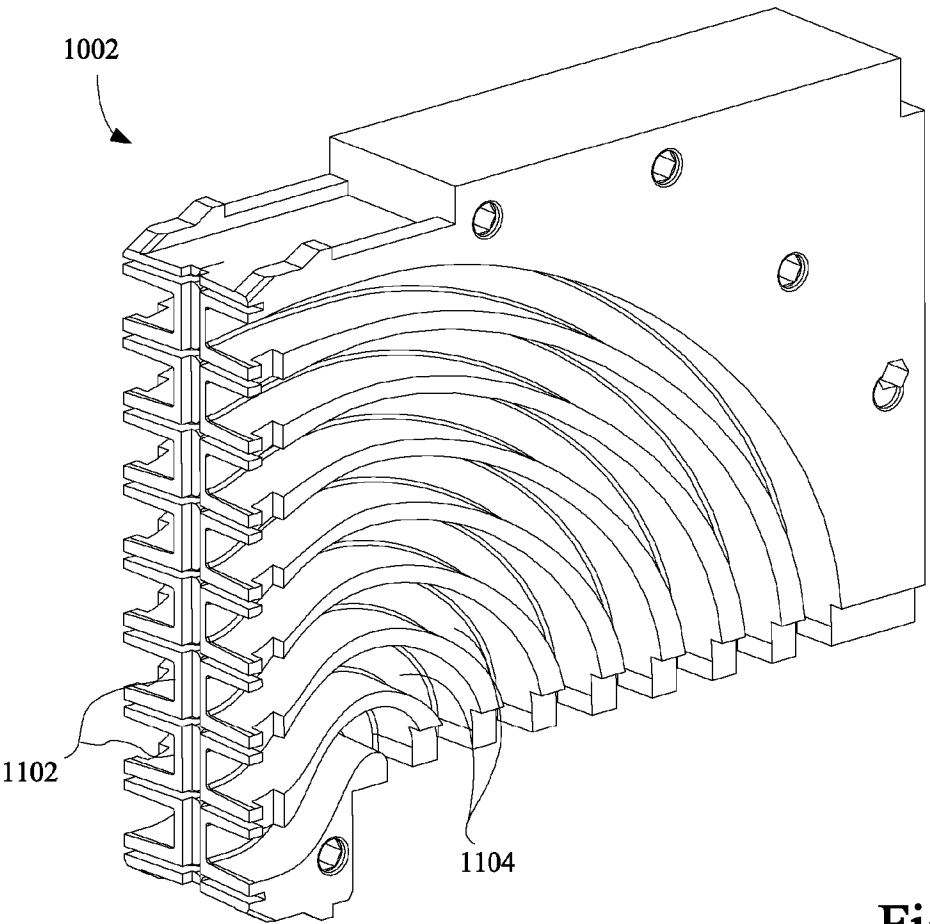
FIG. 11 shows a housing component of the electrical connector system of FIG. 9.

FIG. 11 shows more detail of the housing component 1002. In one implementation, the housing component 1002 includes a conductive surface that defines a plurality of channels dimensioned to receive one or more arrays of electrical contacts. The housing component 1002 may include a plurality of channels on each side face of the housing component 1002. For example, the housing component 1002 may include a first plurality of channels 1102 on a first side face of the housing component 1002, and a second plurality of channels 1104 on a second side face of the housing component 1002. Therefore, the housing component 1002 may accommodate an array of electrical contacts on each side. The channels 1102 on the first side face of the housing component 1002 may be substantially similar to the channels 1104 on the second side face of the housing component 1002. The housing component 1002 may be formed of similar materials as the housing components 306, 308, and 310, as described above.

Figure 12:
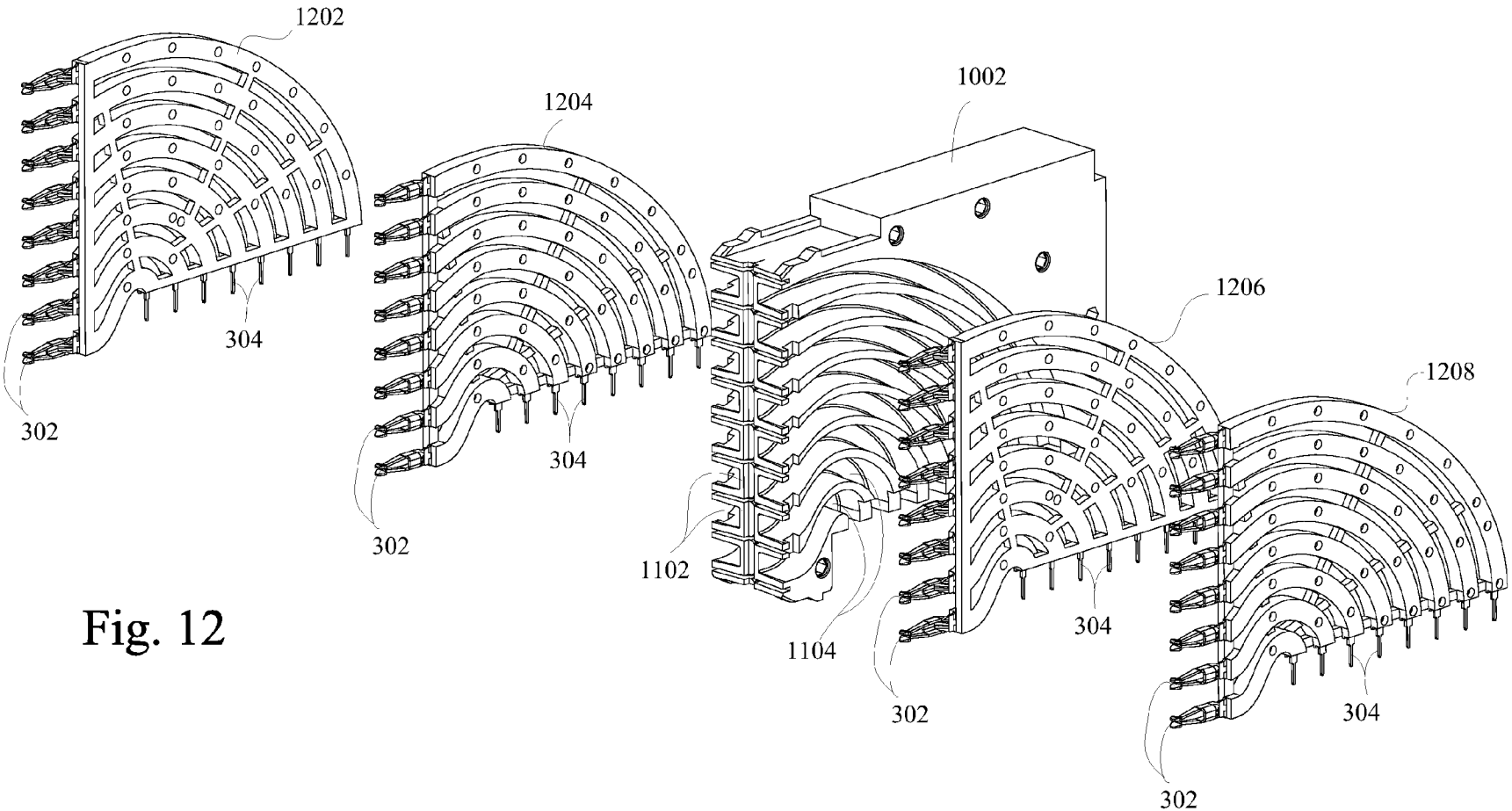
FIG. 12 shows arrays of electrical contacts being placed into channels in the housing component of FIG. 11.

FIG. 12 shows multiple arrays of electrical contacts 1202, 1204, 1206, and 1208 being placed into the channels 1102 and 1104 of the housing component 1002. The arrays of electrical contacts 1202, 1204, 1206, and 1208 may be identical or substantially similar to the arrays of electrical contacts 702, 704, 706, and 708 described above in connection with FIG. 7. For example, each of the arrays of electrical contacts 1202, 1204, 1206, and 1208 may include a plurality of electrical paths, may include an overmolded insulation layer, and may include substrate engagement elements, such as mating connectors 302 and mounting connectors 304.

In FIG. 12, the array of electrical contacts 1202 and the array of electrical contacts 1204 are being positioned substantially within the channels 1102 on the first side face of the housing component 1002. The channels 1102 on the first side face of the housing component 1002 are dimensioned to house multiple arrays of electrical contacts, such as both the array of electrical contacts 1202 and the array of electrical contacts 1204. Similarly, the array of electrical contacts 1206 and the array of electrical contacts 1208 are being positioned substantially within the channels 1104 on the second side face of the housing component 1002. The channels 1104 on the second side face of the housing component 1002 are dimensioned to house multiple arrays of electrical contacts, such as both the array of electrical contacts 1206 and the array of electrical contacts 1208.

The electrical contact channels 1102 and 1104 in the housing component 1002 may be lined with an insulation layer, such as an overmolded plastic dielectric, so that when the arrays of electrical contacts are positioned substantially within their respective channels, the insulation layer electrically isolates the electrical contacts of the arrays from the conductive surface of the housing component 1002. In other implementations, the insulation layer may be applied directly to the arrays of electrical contacts to electrically isolate conductive portions of the arrays from the electrically conductive surfaces of the electrical contact channels.

In one implementation, the array of electrical contacts 1202 may be paired with the array of electrical contacts 1204 to form a first plurality of differential pairs of electrical contacts. The array of electrical contacts 1206 may be paired with the array of electrical contacts 1208 to form a second plurality of differential pairs of electrical contacts.

When the array of electrical contacts 1202 and the array of electrical contacts 1204 are positioned substantially within the plurality of channels 1102 on the first side of the housing component 1002, each electrical contact of the array of electrical contacts 1202 may be positioned adjacent to an electrical contact of the array of electrical contacts 1204. In some implementations, the arrays of electrical contacts 1202 and 1204 are positioned in the plurality of channels such that a distance between adjacent electrical contacts is substantially the same throughout the wafer assembly. Together, the adjacent electrical contacts of the arrays of electrical contacts 1202 and 1204 form a series of electrical contact pairs. In some implementations, the electrical contact pairs may be differential pairs of electrical contacts. For example, the electrical contact pairs may be used for differential signaling.

Similarly, when the array of electrical contacts 1206 and the array of electrical contacts 1208 are positioned substantially within the plurality of channels 1104 on the second side of the housing component 1002, each electrical contact of the array of electrical contacts 1206 may be positioned adjacent to an electrical contact of the array of electrical contacts 1208. In some implementations, the adjacent electrical contacts of the arrays of electrical contacts 1206 and 1208 form a series of electrical contact pairs, such as differential signaling pairs of electrical contacts.

Figure 13:
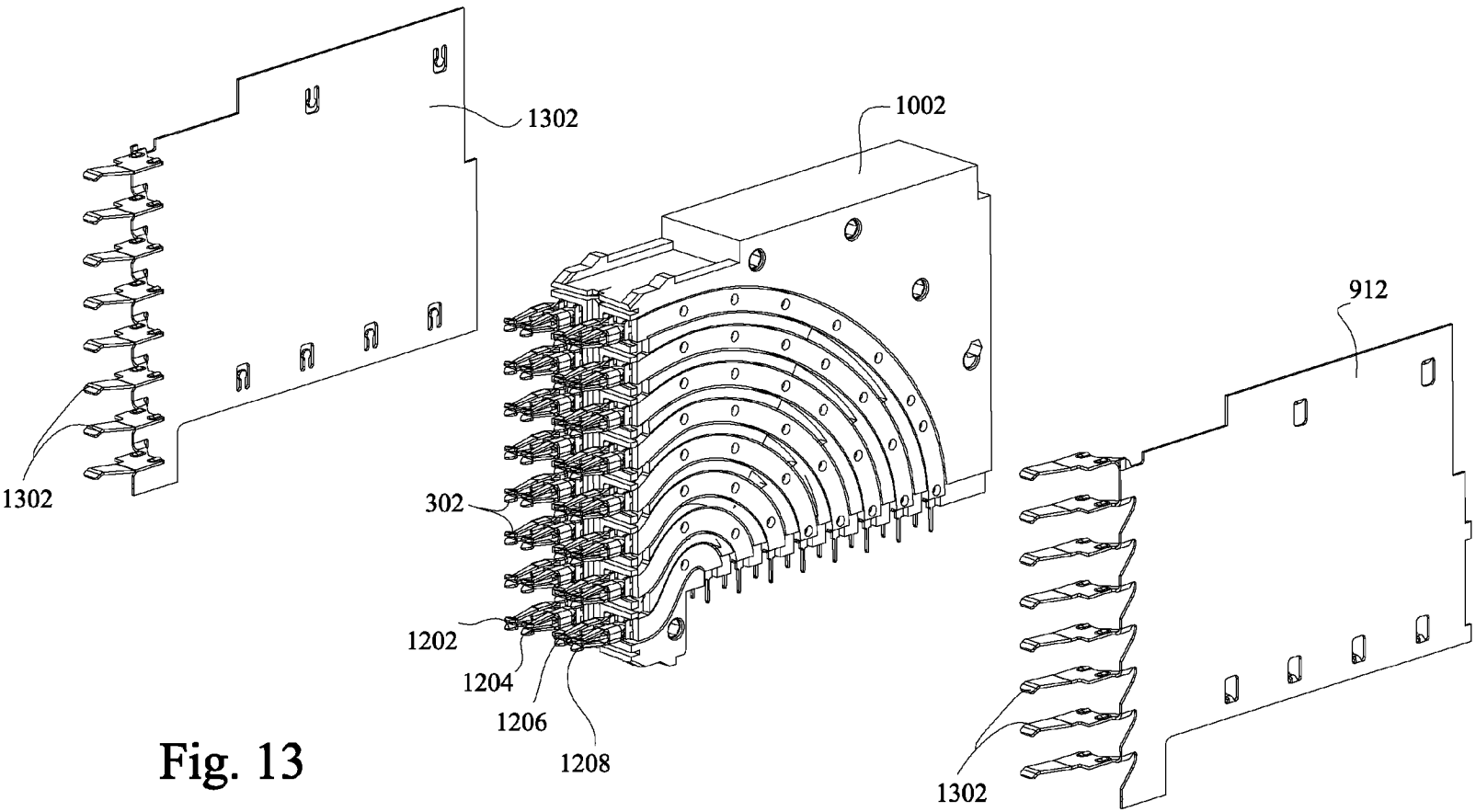
FIG. 13 shows two ground shields coupled with the housing component of FIG. 11.

FIG. 13 shows the multiple arrays of electrical contacts fit into the channels of the housing component 1002. An insulation layer, such as the overmolded insulation layer applied to the arrays of electrical contacts, may electrically isolate at least a portion of one array of electrical contacts from the adjacent array of electrical contacts. FIG. 13 also shows the ground shield 912 and a ground shield 1302 being coupled with the housing component 1002 on both sides of the housing component 1002. Alternatively, a ground shield may be coupled with only one side of the housing component 1002. The ground shields 912 and 1302 may be attached to an outer surface of the housing 1002 or may be integral portions of the housing component 1002. In one implementation, the ground shield 1302 comprises a face that separates the arrays of electrical contacts 1202 and 1204 from electrical contact arrays housed within an adjacent housing component. Similarly, the ground shield 912 may comprise a face that separates the arrays of electrical contacts 1206 and 1208 from electrical contact arrays housed within a different adjacent housing component. Like the ground shield 710 shown coupled with the center housing 308 in FIG. 7, the ground shields 912 and 1302 in FIG. 13 may include a plurality of ground tabs 1304 dimensioned to extend past the mating end of the housing component 1002 and block a line-of-sight between each mating connector 302 of an array of electrical contacts.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. An electrical connector system, comprising:

a center housing defining a plurality of first electrical contact channels on a first side face of the center housing and a plurality of second electrical contact channels on a second side face of the center housing;

a first array of electrical contacts positioned substantially within the plurality of first electrical contact channels on the first side face of the center housing; and a second array of electrical contacts positioned substantially within the plurality of second electrical contact channels on the second side face of the center housing;

wherein the first array of electrical contacts is paired with a third array of electrical contacts to form a first plurality of differential pairs of electrical contacts, and wherein the second array of electrical contacts is paired with a fourth array of electrical contacts to form a second plurality of differential pairs of electrical contacts.

2. The electrical connector system of claim 1, wherein the first array of electrical contacts is configured to connect with a first substrate and a second substrate, and wherein the first array of electrical contacts provides a plurality of signal transmission paths between the first substrate and the second substrate.

3. The electrical connector system of claim 1, wherein the first array of electrical contacts comprises a conductive leadframe at least partially surrounded by an overmolded insulation layer.

4. The electrical connector system of claim 3, wherein the plurality of first electrical contact channels comprise electrically conductive surfaces, and wherein the overmolded insulation layer of the first array of electrical contacts electrically isolates the first array of electrical contacts from the electrically conductive surfaces of the plurality of first electrical contact channels.

5. The electrical connector system of claim 1, wherein the first array of electrical contacts defines a plurality of first signal substrate engagement elements dimensioned to extend past a mounting end of the center housing and connect with a plurality of first signal vias of a substrate, and wherein the second array of electrical contacts defines a plurality of second signal substrate engagement elements dimensioned to extend from the mounting end of the center housing and connect with a plurality of second signal vias of the substrate.

6. The electrical connector system of claim 1, wherein the first array of electrical contacts defines a plurality of mating connectors dimensioned to extend past a mating end of the center housing and engage with corresponding mating connectors of a substrate, the system further comprising:

a ground shield coupled with the center housing, wherein the ground shield comprises a plurality of ground tabs dimensioned to extend past the mating end of the center housing and block a line-of-sight between each mating connector of the first array of electrical contacts.

7. The electrical connector system of claim 1, wherein the plurality of first electrical contact channels on the first side face of the center housing are dimensioned to house both the first array of electrical contacts and the third array of electrical contacts, and wherein the plurality of second electrical contact channels on the second side face of the center housing are dimensioned to house both the second array of electrical contacts and the fourth array of electrical contacts.

8. The electrical connector system of claim 7, further comprising:

a first ground shield coupled with the center housing on the first side face of the center housing, wherein the first ground shield comprises a face that separates the first and third arrays of electrical contacts from electrical contact arrays housed within a first adjacent housing component; and a second ground shield coupled with the center housing on the second side face of the center housing, wherein the second ground shield comprises a face that separates the second and fourth arrays of electrical contacts from electrical contact arrays housed within a second adjacent housing component.

9. The electrical connector system of claim 8, wherein the first array of electrical contacts defines a plurality of mating connectors dimensioned to extend past a mating end of the center housing and engage with corresponding mating connectors of a substrate, and wherein the second array of electrical contacts defines a plurality of mating connectors dimensioned to extend past the mating end of the center housing and engage with corresponding mating connectors of the substrate; and wherein the first ground shield comprises a plurality of ground tabs dimensioned to extend past the mating end of the center housing and block a line-of-sight between each mating connector of the first array of electrical contacts, and wherein the second ground shield comprises a plurality of ground tabs dimensioned to extend past the mating end of the center housing and block a line-of-sight between each mating connector of the second array of electrical contacts.

10. The electrical connector system of claim 1, wherein the plurality of first electrical contact channels on the first side face of the center housing are dimensioned to house the first array of electrical contacts, and wherein the third array of electrical contacts are housed within a plurality of electrical contact channels of a different housing.

11. An electrical connector system, comprising:

a first center housing defining a plurality of first electrical contact channels on a first side face of the first center housing and a plurality of second electrical contact channels on a second side face of the first center housing;

a first array of electrical contacts positioned substantially within the plurality of first electrical contact channels on the first side face of the first center housing;

a second center housing defining a plurality of first electrical contact channels on a first side face of the second center housing and a plurality of second electrical contact channels on a second side face of the second center housing; and a second array of electrical contacts positioned substantially within the plurality of second electrical contact channels on the second side face of the second center housing;

wherein the first and second center housings are positioned adjacent to one another in the electrical connector system such that the first array of electrical contacts is positioned adjacent to the second array of electrical contacts to form a plurality of differential pairs of electrical contacts by pairing contacts of the first array of electrical contacts with contacts of the second array of electrical contacts.

12. The electrical connector system of claim 11, further comprising:

a third array of electrical contacts positioned substantially within the plurality of second electrical contact channels on the second side face of the first center housing; and a fourth array of electrical contacts positioned substantially within the plurality of first electrical contact channels on the first side face of the second center housing;

wherein the third array of electrical contacts is paired with a fifth array of electrical contacts to form a second plurality of differential pairs of electrical contacts, and wherein the fourth array of electrical contacts is paired with a sixth array of electrical contacts to form a third plurality of differential pairs of electrical contacts.

13. The electrical connector system of claim 12, further comprising a third center housing defining a plurality of first electrical contact channels on a first side face of the third center housing and a plurality of second electrical contact channels on a second side face of the third center housing, wherein the third center housing houses the fifth array of electrical contacts in the plurality of first electrical contact channels on the first side face of the third center housing.

14. The electrical connector system of claim 12, further comprising an end housing defining a plurality of electrical contact channels on a side face of the end housing, wherein the end housing houses the fifth array of electrical contacts in the plurality of electrical contact channels on the side face of the end housing.

15. The electrical connector system of claim 11, wherein the first array of electrical contacts defines a plurality of mating connectors dimensioned to extend past a mating end of the first center housing and engage with corresponding mating connectors of a substrate, the system further comprising:

a ground shield coupled with the first center housing, wherein the ground shield comprises a plurality of ground tabs dimensioned to extend past the mating end of the first center housing and block a line-of-sight between each mating connector of the first array of electrical contacts.

16. An electrical connector system, comprising:

a center housing defining a plurality of first electrical contact channels on a first side face of the center housing and a plurality of second electrical contact channels on a second side face of the center housing;

a first array of electrical contacts positioned substantially within the plurality of first electrical contact channels on the first side face of the center housing;

a second array of electrical contacts positioned substantially within the plurality of second electrical contact channels on the second side face of the center housing;

a first end housing defining a plurality of electrical contact channels on a side face of the first end housing;

a third array of electrical contacts positioned substantially within the plurality of electrical contact channels on the side face of the first end housing;

a second end housing defining a plurality of electrical contact channels on a side face of the second end housing; and a fourth array of electrical contacts positioned substantially within the plurality of electrical contact channels on the side face of the second end housing;

wherein the first array of electrical contacts is part of a different differential signaling pair of arrays than the second array of electrical contacts.

17. The electrical connector system of claim 16, wherein the first array of electrical contacts is part of a first differential signaling pair of arrays with the third array of electrical contacts, and wherein the second array of electrical contacts is part of a second differential signaling pair of arrays with the fourth array of electrical contacts.

18. The electrical connector system of claim 16, wherein the first array of electrical contacts is part of a first differential signaling pair of arrays with a fifth array of electrical contacts, wherein the second array of electrical contacts is part of a second differential signaling pair of arrays with a sixth array of electrical contacts, wherein the third array of electrical contacts is part of a third differential signaling pair of arrays with a seventh array of electrical contacts, and wherein the fourth array of electrical contacts is part of a fourth differential signaling pair of arrays with an eighth array of electrical contacts.

19. The electrical connector system of claim 16, further comprising one or more additional center housings coupled with the center housing between the first end housing and the second end housing, wherein the one or more additional center housings define electrical contact channels to house a plurality of additional arrays of electrical contacts.

20. The electrical connector system of claim 16, wherein the first array of electrical contacts defines a plurality of mating connectors dimensioned to extend past a mating end of the center housing and engage with corresponding mating connectors of a substrate, wherein the third array of electrical contacts defines a plurality of mating connectors dimensioned to extend past a mating end of the first end housing and engage with corresponding mating connectors of the substrate, the system further comprising:

a first ground shield coupled with the center housing, wherein the first ground shield comprises a plurality of ground tabs dimensioned to extend past the mating end of the center housing and block a line-of-sight between each mating connector of the first array of electrical contacts; and a second ground shield coupled with the first end housing, wherein the second ground shield comprises a plurality of ground tabs dimensioned to extend past the mating end of the first end housing and block a line-of-sight between each mating connector of the third array of electrical contacts.

21. The electrical connector system of claim 16, wherein the center housing comprises a conductive plated plastic housing, wherein the plurality of first electrical contact channels of the center housing comprise electrically conductive surfaces; and wherein the first array of electrical contacts comprises a conductive leadframe at least partially surrounded by an overmolded insulation layer, wherein the overmolded insulation layer of the first array of electrical contacts electrically isolates the first array of electrical contacts from the electrically conductive surfaces of the plurality of first electrical contact channels.

22. An electrical connector system, comprising:

a center housing defining a plurality of first electrical contact channels on a first side face of the center housing and a plurality of second electrical contact channels on a second side face of the center housing;

a first array of electrical contacts positioned substantially within the plurality of first electrical contact channels on the first side face of the center housing;

a second array of electrical contacts positioned substantially within the plurality of first electrical contact channels on the first side face of the center housing;

a third array of electrical contacts positioned substantially within the plurality of second electrical contact channels on the second side face of the center housing; and a fourth array of electrical contacts positioned substantially within the plurality of second electrical contact channels on the second side face of the center housing;

wherein the first array of electrical contacts is paired with the second array of electrical contacts to form a first plurality of differential pairs of electrical contacts, and wherein the third array of electrical contacts is paired with the fourth array of electrical contacts to form a second plurality of differential pairs of electrical contacts.

23. The electrical connector system of claim 22, further comprising:

a first ground shield coupled with the center housing on the first side face of the center housing, wherein the first ground shield comprises a face that separates the first and second arrays of electrical contacts from electrical contact arrays housed within a first adjacent housing component; and a second ground shield coupled with the center housing on the second side face of the center housing, wherein the second ground shield comprises a face that separates the third and fourth arrays of electrical contacts from electrical contact arrays housed within a second adjacent housing component.

24. The electrical connector system of claim 23, wherein the first array of electrical contacts defines a plurality of mating connectors dimensioned to extend past a mating end of the center housing and engage with corresponding mating connectors of a substrate, and wherein the third array of electrical contacts defines a plurality of mating connectors dimensioned to extend past the mating end of the center housing and engage with corresponding mating connectors of the substrate; and wherein the first ground shield comprises a plurality of ground tabs dimensioned to extend past the mating end of the center housing and block a line-of-sight between each mating connector of the first array of electrical contacts, and wherein the second ground shield comprises a plurality of ground tabs dimensioned to extend past the mating end of the center housing and block a line-of-sight between each mating connector of the third array of electrical contacts.

* * * * *